US006296125B1

(12) United States Patent
Dudley

(10) Patent No.: US 6,296,125 B1
(45) Date of Patent: Oct. 2, 2001

(54) CENTRIFUGAL CHIP SEPARATOR INCLUDING REMOVABLE BLADES

(76) Inventor: Russell D. Dudley, 3916 Old Field Trail, Kalamazoo, MI (US) 49008

( * ) Notice: Subject to any disclaimer, the term of this patent is extended or adjusted under 35 U.S.C. 154(b) by 0 days.

(21) Appl. No.: 09/488,036

(22) Filed: Jan. 20, 2000

(51) Int. Cl.[7] ..... B04B 7/12

(52) U.S. Cl. ..... 210/373; 210/380.1; 29/402.01; 494/36; 494/79

(58) Field of Search ..... 494/12, 36, 37, 494/43, 50, 51, 52, 55, 64, 74, 79, 80, 85; 210/232, 360.1, 373, 374, 375, 377, 380.1; 29/402.01, 402.08

(56) References Cited

U.S. PATENT DOCUMENTS

| | | | |
|---|---|---|---|
| Re. 35,307 | 7/1996 | Nemedi . | |
| 695,158 | 3/1902 | Lafferty . | |
| 994,553 | 6/1911 | Alexander . | |
| 1,362,973 | 12/1920 | Vardell . | |
| 1,520,467 | 12/1924 | Frantz . | |
| 1,853,249 | 4/1932 | Ainlay . | |
| 2,312,545 | 3/1943 | Haug . | |
| 2,435,665 | 2/1948 | Wollaver . | |
| 2,748,668 | 6/1956 | Hornbostel . | |
| 3,012,710 | 12/1961 | Steinacker . | |
| 3,216,042 | 11/1965 | Strittmatter . | |
| 3,366,318 | 1/1968 | Steimel . | |
| 3,519,136 | 7/1970 | Lega et al. . | |
| 3,850,814 | 11/1974 | Dudley . | |
| 4,082,675 | 4/1978 | Heckmann . | |
| 4,122,014 | * 10/1978 | Weininger et al. | 210/377 |

(List continued on next page.)

FOREIGN PATENT DOCUMENTS 896863 5/1962 (GB) .

OTHER PUBLICATIONS

Drawing—Titan Systems, Kalamazoo, Michigan (Division French Systems, Inc.) labeled "Centrifuge Assembly" and having a date appearing to be Mar. 19, 1987.

Photograph—Titan System illustrated in drawing of Exhibit A (no date).

Photograph—Titan System illustrated in drawing of Exhibit A bearing date legend of Mar. 29, 1985.

Photograph—titan System illustrated in Exhibit A (no date).

Photograph—Titan System illustrated in Exhibit A (no date).

Drawing—Titan Div./French Systems, Inc. labeled "T1–30 Centrifuge Assy"; dated Jan. 2, 1985; Drawing No. 1001–DA.

(List continued on next page.)

*Primary Examiner*—Charles E. Cooley
(74) *Attorney, Agent, or Firm*—Price Heneveld Cooper Dewitt & Litton

(57) ABSTRACT

A centrifugal device for separating lubricating or other fluid from fluid impregnated scrap, metal shavings or the like, includes a separator bowl disposed within the centrifuge device and a drive mechanism for rotating the separator bowl. The separator bowl includes a bottom wall and an angled side wall. A plurality of blades include bottom flanges and angled side flanges that mateably engage the bottom wall and the side wall, respectively. Threaded fasteners each include a head abutting an exterior surface of the side wall and a shaft that extends through the side wall and threadably into an associated one of the blades. The fastener heads characteristically are positioned in a location where the heads are readily accessible from outside the separator bowl and where the heads will not be worn by the scrap and metal shavings processed through the centrifugal device. A slotted clamp plate clampingly secures the bottom flanges to the bowl bottom to securely retain the blades in place.

12 Claims, 3 Drawing Sheets

U.S. PATENT DOCUMENTS

| | | | | |
|---|---|---|---|---|
| 4,137,176 | | 1/1979 | Dudley et al. . | |
| 4,186,096 | | 1/1980 | Areaux et al. . | |
| 4,186,097 | | 1/1980 | Dudley et al. . | |
| 4,253,960 | | 3/1981 | Dudley et al. . | |
| 4,298,476 | | 11/1981 | Dudley . | |
| 4,310,417 | | 1/1982 | Dudley et al. . | |
| 4,936,822 | | 6/1990 | Nemedi . | |
| 5,252,208 | * | 10/1993 | Nemedi | 210/373 |
| 5,264,124 | * | 11/1993 | Nemedi | 494/36 |
| 5,275,727 | * | 1/1994 | Nemedi | 210/373 |
| 5,330,637 | * | 7/1994 | Nemedi | 210/373 |
| 5,345,665 | * | 9/1994 | Nemedi | 210/373 |
| 5,383,941 | * | 1/1995 | Nemedi | 210/380.1 |
| 5,635,065 | * | 6/1997 | Spyra | 210/377 |
| 5,651,881 | * | 7/1997 | Dudley | 210/374 |
| 5,720,877 | | 2/1998 | Dudley . | |
| 5,858,236 | * | 1/1999 | Dudley | 494/36 |
| 5,944,992 | * | 8/1999 | Nemedi et al. | 210/380.1 |
| 6,039,869 | * | 3/2000 | Dudley | 494/36 |
| 6,073,778 | * | 6/2000 | Dudley | 494/36 |
| 6,129,851 | * | 10/2000 | Nemedi et al. | 494/36 |

OTHER PUBLICATIONS

Drawing—titan Systems labeled "T1–30 Sect Thru Bowl"; dated Jan. 6, 1985; Drawing No. 1002–DA.

Drawing—Titan Systems, Kalamazoo, Michigan (Division French Systems, Inc.) labeled "Vanes–Clamp Plate T1–42"; dated Apr. 2, 1987; Drawing No. 1185–D.

Declaration:– In re Reissue Application of: William D. Nemedi; Patent No. 4,936,822; issued Jun. 26, 1990; for Chip Wringer Bowl/Blade Improvement.

Information Disclosure Statement In Re Reissue Application of: William D. Nemedi; Patent No. 4,936,822; issued Jun. 26, 1990; for Chip Wringer Bowl/Blade Improvement.

* cited by examiner

CENTRIFUGAL CHIP SEPARATOR INCLUDING REMOVABLE BLADES

BACKGROUND OF THE INVENTION

The present invention concerns a centrifugal chip separator having an improved blade arrangement that facilitates adjustment, maintenance, and repair of the chip separator.

Centrifuge devices are known in prior art for continuously removing liquid from metal chips, turnings, or other agglomerated scrap material. For example, see U.S. Pat. Nos. Re 35307; 3,366,318; and 4,186,096. These centrifuge devices include a centrifuge bowl where the liquid is centrifugally separated from the agglomerated scrap as the bowl is spun. Blades are positioned in the bowl to motivate the agglomerated scrap around the bowl. The bowl and blades are subject to severe wear and must often be repaired or replaced, because the metal chips are abrasive and cause extensive wear as they impact and slide across the bowl and blade surfaces. The blades in particular are subject to wear since they impact and motivate the scrap as the scrap is initially introduced into the bowl and as the bowl is spun. Repair or maintenance of bowls and blades has been achieved in different ways, such as by replaceable liners, replaceable bowls, replaceable blades, hardened material welded into bowls and liners, etc. However, sooner or later, all blades and/or bowls need repair or replacement. The repair and/or mainenance is a very time-consuming and potentially hazardous job due to the confined space in which the work must be performed. Further, the repair and/or maintenance is unfortunately a very messy and smelly job due to the residue of particles and liquid in the centrifuge bowl. It is highly desirable to provide an arrangement that facilitates repair and/or lets maintenance workers do their job without placing themselves in the potentially hazardous situations.

Reissue patent Re. 35,307 discloses a centrifuge that has independently removable blades. However, in Reissue '307, the screw heads are located inside the bowl in exposed positions. As a result, the hex recess or slot in the screw heads may wear, making it difficult to engage the screw head with enough torsional force to rotate and remove the screw. In extreme cases, the screw head may wear away to such an extent that the hex recess or slot is no longer present, and/or the head is so worn that the blades may not easily be removable. This would potentially require complete replacement of the entire bowl or blade assembly. One embodiment shown in patent '307 includes multiple discrete recesses formed on an inside surface of the bowl wall. This may reduce wear on the blades in some circumstances, but discrete recesses are expensive to form in centrifuge bowls, such that this adds considerably to the expense in centrifuge devices having bowls with recesses therein. Notably, the design of FIGS. 2–5 in Reissue '307 fails to provide the claimed advantage of the elimination of bowl wear since wear occurs not only on the wear shoe but on the bowl at the interface between the blade wear shoe and bowl recess. A blade with the wear shoe above the surface of the inner bowl wall is far better than the recessed design since the chips are elevated away from the inner bowl wall surface.

As inferred above, one reason that maintenance of the centrifuge bowl and the blades is difficult is because it requires that the mechanic enter or reach inside of the centrifuge bowl. Bowls are normally very dirty, oily, and slippery, since they are covered with particles and debris mixed with coolant, oil, cutting fluids, and residue from the centrifuging process. Not only is the environment unpleasant and potentially dangerously slippery, it is also very confined, dark, and generally difficult to work in. Depending on how unclean the bowl is, the particles and debris can make it difficult to properly "seat" a replacement blade, such as the blades shown in patent Re35307, against a bowl interior surface.

Therefore, an apparatus solving the aforementioned problems and having the aforementioned advantages is desired.

SUMMARY OF THE PRESENT INVENTION

In one aspect of the present invention, a centrifugal device for separating lubricating or other fluid from fluid impregnated scrap, metal shavings or the like, includes a separator bowl disposed within the centrifuge device, and a drive mechanism for rotating the separator bowl. The separator bowl includes a bottom wall and a side wall. At least one blade engages the bottom wall and the side wall. Threaded fasteners each include a head abutting an exterior surface of the side wall and a shaft that extends through the side wall and threadably into an associated one of the blades. The heads characteristically are positioned in a location where the heads are readily accessible from outside the separator bowl and where the heads will not be worn by the scrap and metal shavings processed through the centrifugal device.

In another aspect of the present invention, a method of maintaining a centrifugal device for separating lubricating or other fluid from fluid impregnated scrap, metal shavings or the like, includes steps of: providing a separator bowl disposed within the centrifuge device, a drive mechanism for rotating the separator bowl, and a plurality of blades engaging the bottom wall and the side wall. The method further includes extending fasteners through a side wall of the bowl, with the fasteners each including a head abutting an exterior surface of the side wall and a shaft extending through the side wall and threadably into an associated one of the blades. When installed, the heads are characteristically positioned in a location where the heads are readily accessible from outside the separator bowl and where the heads will not be worn by the scrap and metal shavings processed through the centrifugal device.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 1:
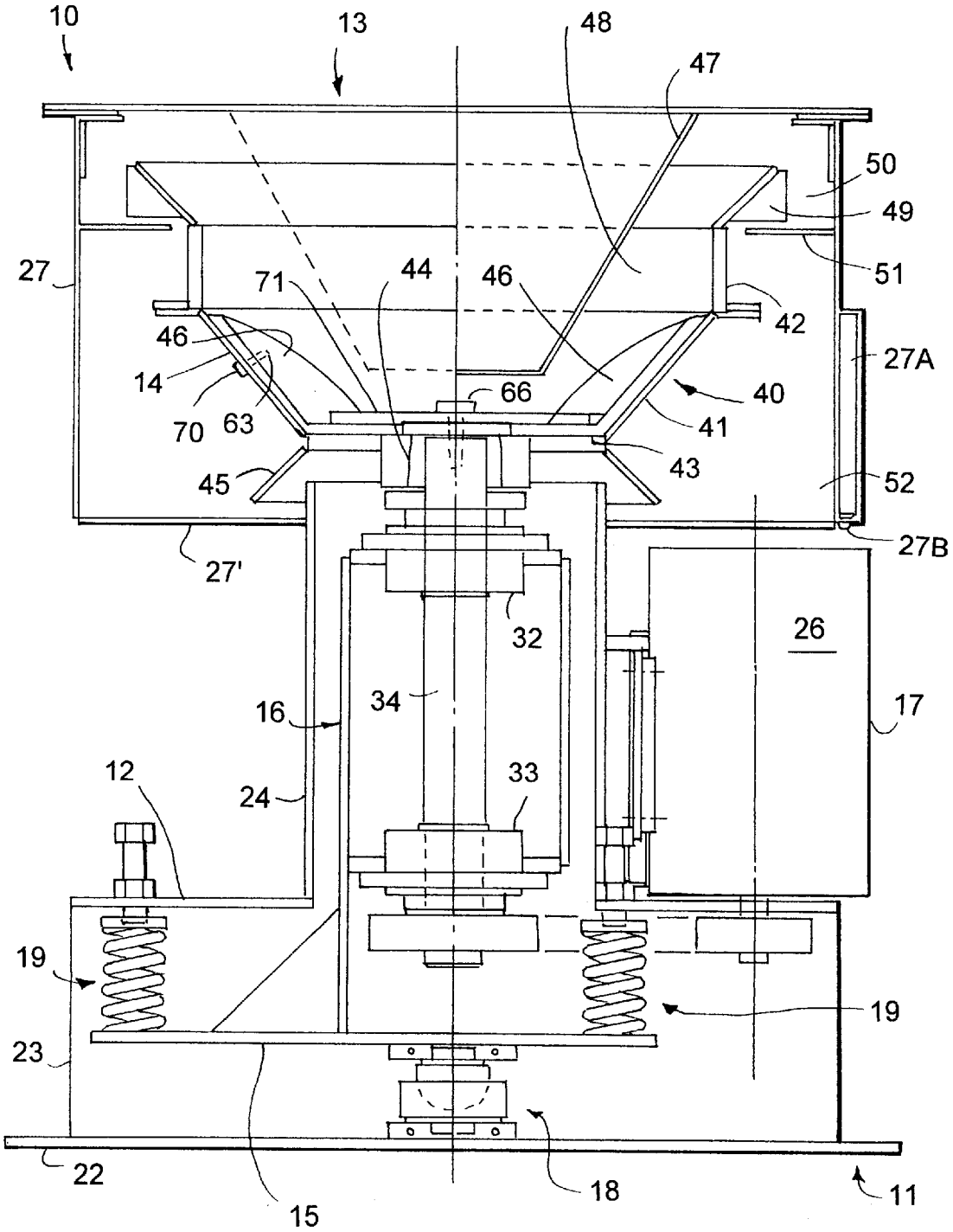
FIG. 1 is a side cross-sectional view of a centrifugal chip separator embodying the present invention.

A centrifugal clip separator 10 (FIG. 1) embodying the present invention includes a rotatable centrifuge bowl 14 and a plurality of blades 46 removably secured to the bowl 14 by fasteners or screws 63 and a clamp plate 65. Advantageously, the screws 63 have heads 70 located outside the bowl 14 where the heads 70 do not experience wear and where the heads 70 are easy to access, thus facilitating maintenance, as described below.

Briefly described, the centrifugal chip separator 10 (FIG. 1) includes a base 11 having a raised platform 12. A centrifuge device 13 includes the centrifugal bowl 14 for separating coolant and cutting fluid from metal chips, and further includes a centrifuge support plate 15 that supports the centrifuge device 13 via a stand 16. A drive mechanism 17 is operably mounted on the stand 16. A mount 18 operably supports the centrifuge support plate 15 on a bottom of the base 11 for limited non-axial movement as the centrifuge device 13 is operated. A plurality of biasing devices 19 are extended between the centrifuge support plate 15 and the raised platform 12. The arrangement allows use of lifters 21 to raise the centrifuge support plate 15 to separate the mount 18 for repair, without maintenance personnel having to work in the mess and debris around the mount 18 to disconnect the mount 18.

Base 11 (FIG. 1) includes a floor-engaging bottom plate 22 and side walls 23 that support the raised platform 12 above the bottom plate 22. The raised platform 12 includes a center hole, and a cylindrical outer tower 24 is attached to the raised platform 12 around the center hole and extends upwardly. The outer tower 24 protects the stand 16, and further provides a stationary support for the motor 26 and for the cylindrical outer wall 27 and bottom 27' of housing 28. A door 27A, hinged at a bottom 27B to outer wall 27, may be provided to cover a large access opening 27C in the outer wall 27. The large access opening 27C provides easy access to the heads 70 of the screws 63.

Figure 2:
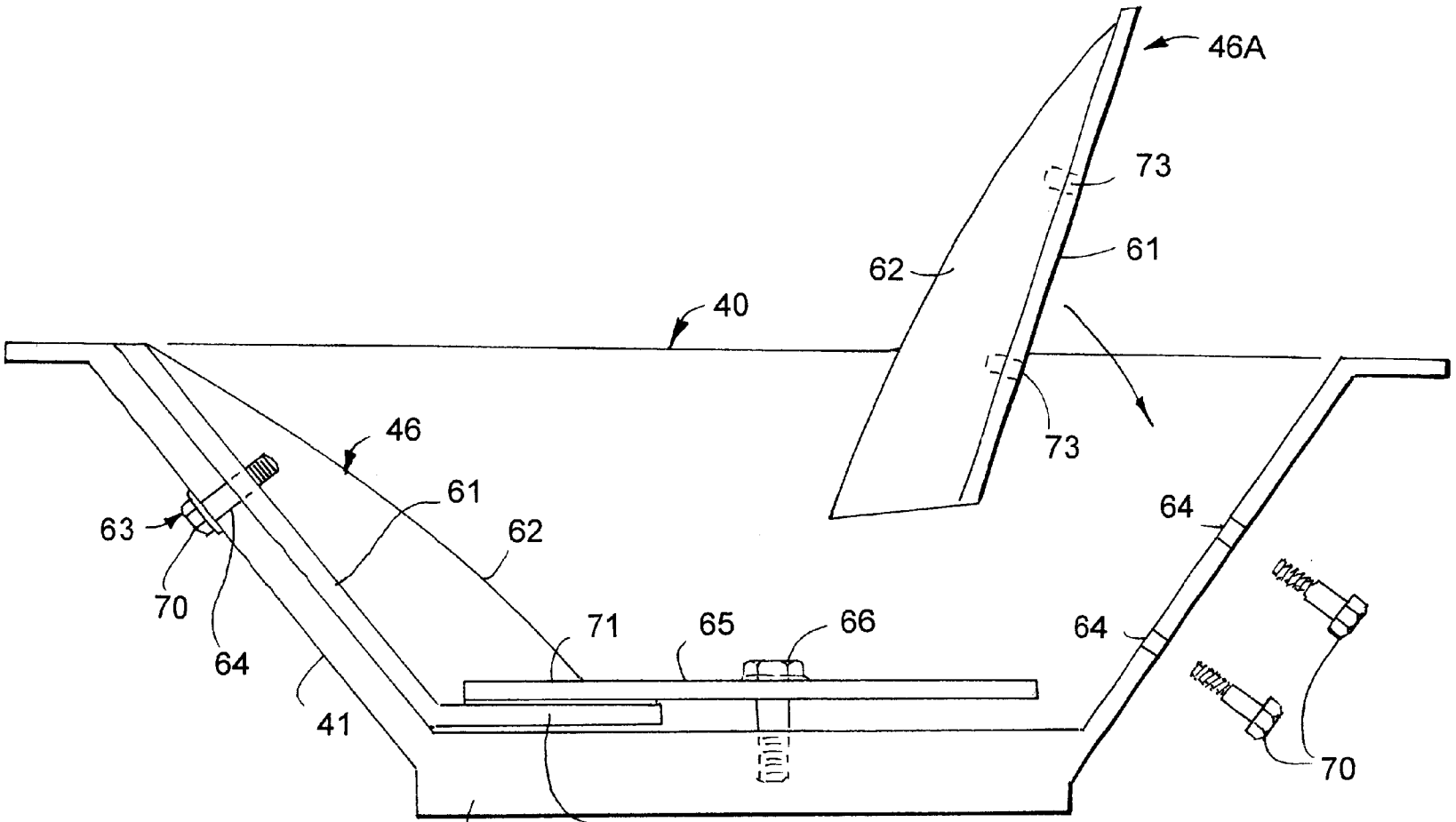
FIG. 2 is a cross-sectional view of the separator bowl shown in FIG. 1 with one blade exploded away.
Figure 3:
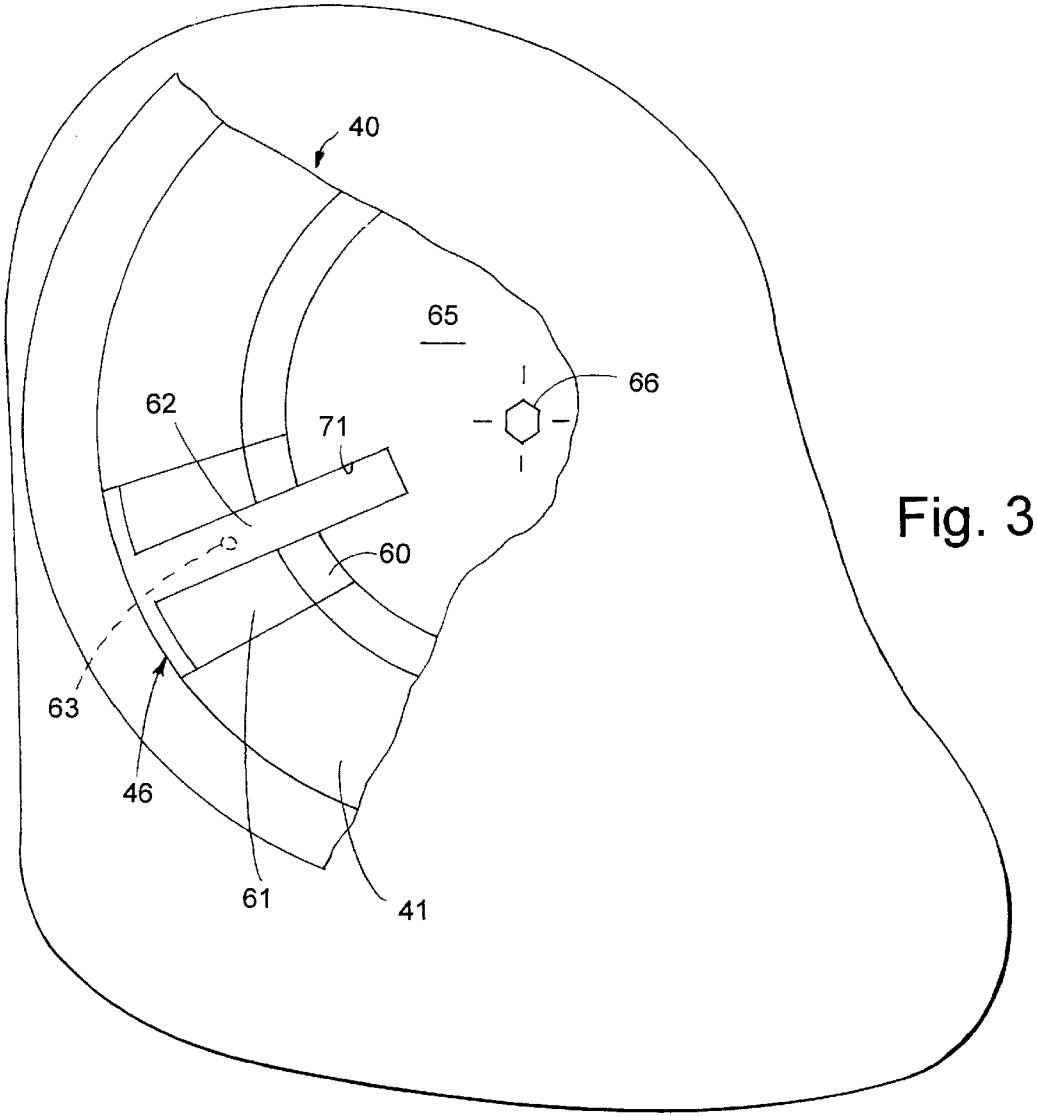
FIG. 3 is a fragmentary top view of FIG. 2.

Separator bowl 40 (FIG. 2) has side walls formed by an angled wall section 41 and an apertured wall section 42. The separator bowl 40 further includes a bottom wall 43 connected to the drive shaft 34 by connection 44. An outwardly angled curtain 45 extends from the bottom wall 43 to deflect liquid away from the area of connection 44. Radial blades 46 are included in the bowl 40 to circumferentially motivate liquid-laden metal chips deposited in the separator bowl 40. A conical top 47 contains the chips within the active centrifugal chamber 48 of the bowl during operation. The radial fin blades 49 motivate chips outwardly to a chip receiving area 50 located above horizontal flange 51, while the liquid passes through the apertured wall section 42 into a liquid collection area 52 below flange 51.

The blades 46 (FIG. 2) are configured to rest mateably against an inside of the bowl 40. Specifically, the blades 46 include a bottom flange 60 that lies flat against bottom wall 43, a side flange 61 that lies flat against the angled wall section 41, and a blade portion 62 that extends perpendicularly and inwardly from flanges 60 and 61.

One or more screws 63 extend through holes 64 in the angled wall section 41 threadably into the side flanges 61 and the blade portions 62. Preferably, the blade portions 62 are significantly thicker than a diameter of the shaft 69 of the screw 63 such that the screw 63 does not become exposed even after substantial wearing away of the sides of the blade portion 62. For example, it is contemplated that the blade portion 62 can be one inch or more in thickness. Further, the screws 63 have heads 70 positioned outside the bowl 14 where the screw heads 70 do not experience wear from the agglomerated scrap and further where the screw heads 70 remain clean and are easily reached to facilitate maintenance.

The present arrangement includes a flat clamp plate 65 having radial edge slots at locations 71 shaped to closely receive the blade portion 62. The clamp plate 65 is held down by clamp bolt 66 to the bottom wall 43. The edge sections 67 of clamp plate 65 abut the bottom flanges 60 to hold a bottom of the blades 49. Further, the slots 71 engage blade portions 62 and bottom flange 60 in a manner that stabilizes the blades 46.

For some applications, such as lighter duty applications, it is contemplated that the bottom flange 60 and/or the side flange 61, and/or the clamp plate 65 can be eliminated. For example, note modified blade 46A which includes a pair (or more) of threaded holes 73, and that eliminates bottom flange 60. Nonetheless, the clamp plate 65 is believed to be very desirable since it reduces stress on the screws 63 due to its support of the blade portions 62 at the radial edge slots 71 of the clamp plate 65 and further it provides stability due to engagement of clamp plate 65 against the bottom flanges 60.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A centrifugal device for separating lubricating or other fluid from fluid impregnated scrap or metal shavings, comprising:

a rotatable separator bowl disposed within the centrifuge device, the separator bowl including a bottom wall and a side wall;

a drive mechanism for rotating the separator bowl;

at least one blade installed upon an interior surface of the centrifuge bowl and engaging the bottom wall and the side wall; and threaded fasteners each including a head abutting an exterior surface of the side wall and a shaft extending through the side wall and threadably into the at least one blade, with the heads being characteristically positioned in a location where the heads are readily accessible from outside the separator bowl and where the heads will not be worn by the scrap and metal shavings processed through the centrifugal device.

2. The centrifugal device defined in claim 1, including a clamp plate attached to the bottom wall of the separator bowl and that clamps against lower portions of the at least one blade to retain the at least one blade against the bottom wall.

3. The centrifugal device defined in claim 2, wherein the at least one blade includes a blade portion and wherein the threaded fasteners threadably engage the blade portion.

4. The centrifugal device defined in claim 3, wherein the blade portion includes a thickness dimension that is at least about twice a diameter of the shafts of the threaded fasteners.

5. The centrifugal device defined in claim 3, wherein the blade includes an angled flange and a bottom flange connected to the blade portion.

6. The centrifugal device defined in claim 5, wherein the clamp plate comprises a flat structural plate including radially extending slots configured to receive and mateably engage the blade portion of the at least one blade.

7. The centrifugal device defined in claim 1, wherein the at least one blade includes a blade portion and an angled flange extending from the blade portion, but characteristically, does not include a bottom flange extending parallel to and engaging the bottom wall of the separator bowl.

8. The centrifugal device defined in claim 1, wherein the at least one blade includes a blade portion that extends perpendicular to the side wall of the separator bowl and wherein the threaded fasteners threadably engage the blade portion.

9. The centrifugal device defined in claim 1, including a clamp plate that comprises a flat structural plate including radially extending slots configured to receive and mateably engage a blade portion of the at least one blade.

10. The centrifuge device defined in claim 1, wherein the bottom wall and the side wall characteristically define a continuous bowl surface not having separate recesses therein.

11. A method of repair for a centrifugal device for separating lubricating or other fluid from fluid impregnated scrap or metal shavings, comprising steps of:

providing a separator bowl disposed within the centrifuge device, the separator bowl including a bottom wall and a side wall, a drive mechanism for rotating the separator bowl, and a plurality of blades engaging the bottom wall and the side wall; and extending fasteners through the side wall from an outside toward an inside of the separator bowl, the fasteners each including a head abutting an exterior surface of the side wall and a shaft extending through the side wall and threadably into an associated one of the blades, such that the heads are characteristically positioned in a location where the heads are readily accessible from outside the separator bowl and where the heads will not be worn by the scrap and metal shavings processed through the centrifugal device.

12. The method defined in claim 11, including steps of providing a clamp plate, and clamping a bottom of the blades to the separator bowl using the clamp plate.

* * * * *